United States Patent [19]

Chu

[11] 4,378,415

[45] Mar. 29, 1983

[54] COLOR IMAGING, LAYERED ORGANIC PHOTORESPONSIVE DEVICE HAVING HOLE INJECTION AND TRANSPORT LAYERS, RED SENSITIVE LAYER AND SHORT WAVELENGTH SENSITIVE LAYER

[75] Inventor: Joseph Y. C. Chu, Norwalk, Conn.

[73] Assignee: Xerox Corporation, Stamford, Conn.

[21] Appl. No.: 310,931

[22] Filed: Oct. 13, 1981

[51] Int. Cl.[3] ..... G03G 13/01

[52] U.S. Cl. ..... 430/45; 430/46; 430/58; 430/59

[58] Field of Search ..... 430/58, 59, 47, 46

[56] References Cited

U.S. PATENT DOCUMENTS

| | | | |
|---|---|---|---|
| 3,045,644 | 7/1962 | Schwertz | 118/637 |
| 3,687,661 | 8/1972 | Sato et al. | 96/1.2 |
| 3,692,519 | 9/1972 | Takahashi | 96/1.2 |
| 3,702,483 | 11/1972 | Fantuzzo | 346/74 |
| 4,039,831 | 8/1977 | Lehmann | 250/315 |
| 4,045,219 | 8/1977 | Bean | 96/1.2 |
| 4,078,929 | 3/1978 | Gundlach | 96/1.2 |
| 4,181,423 | 1/1980 | Pressman et al. | 355/4 |
| 4,188,213 | 2/1980 | Lehman | 430/43 |
| 4,189,224 | 2/1980 | Sakai | 355/4 |
| 4,228,231 | 10/1980 | Kaukeinen et al. | 430/46 |
| 4,250,239 | 2/1981 | Sakai | 430/42 |
| 4,251,612 | 2/1981 | Chu | 430/59 |

*Primary Examiner*—John D. Welsh
*Attorney, Agent, or Firm*—E. O. Palazzo

[57] ABSTRACT

This invention is directed to a layered organic photoresponsive device, and a method of highlight color imaging, the device being comprised of (1) a supporting substrate, (2) a layer of material capable of injecting holes into a layer on its surface, this layer being comprised of a material selected from the group consisting of carbon dispersed in a polymer, and graphite dispersed in a polymer, (3) a hole transport layer in operative contact with the layer of hole injecting material, which transport layer comprises a combination of a highly insulating organic resin having dispersed therein small molecules of an electrically active material, the combination of which is substantially nonabsorbing to visible light but allows injection of photogenerated holes from a photogenerating layer in contact with the hole transport layer, and electrically induced holes from the layer of injecting material, (4) a red sensitive charge carrier photogenerating layer sensitive to wavelengths ranging from about the visible range to about 620 millimicrons, said layer being transparent to light of wavelengths of greater than 620 millimicrons, (5) a top layer of a photoconductive material sensitive only to relatively short wavelengths ranging from about the visible range to about 620 millimicrons, said layer being transparent to light of wavelengths of greater than 620 millimicrons. Highlight imaging is accomplished by subjecting the above device to negative charges, followed by subjecting the device to positive charges, imagewise exposing the member, and developing with a colored developer composition comprised of positively charged toner components and negatively charged toner components, and carrier particles.

21 Claims, 5 Drawing Figures

STEP I: NEGATIVE CHARGING AND DARK HOLE INJECTION

STEP 2: POSITVE CHARGING

STEP 3: IMAGE EXPOSURE

STEP: 4 DEVELOPMENT

COLOR IMAGING, LAYERED ORGANIC PHOTORESPONSIVE DEVICE HAVING HOLE INJECTION AND TRANSPORT LAYERS, RED SENSITIVE LAYER AND SHORT WAVELENGTH SENSITIVE LAYER

BACKGROUND OF THE INVENTION

This invention is generally directed to a an improved layered organic photoresponsive device, and more specifically the present invention is directed to the utilization of specific materials in a layered organic photoresponsive device, which device is suitable for color highlight imaging systems, especially the single step reproduction of color images, particularly black and red images. In accordance with one aspect of the present invention, there is thus provided an improved layered organic photoresponsive device containing therein certain materials for each of the layers, thereby allowing such a device to have optimal spectral response, excellent photosensitivity, and stable cycling properties.

Two color reproduction systems serving distinct needs, are generally known, namely representational color wherein the colors of the reproduction match those of the original document; and functional color, wherein the color to be reproduced merely serves to mark distinguish or highlight portions of a document such as a text, graphs, or line drawings. In representational color systems, images are xerographically produced for example by three successive color filter exposures, followed by an in register transfer of toner images produced by three toners of the appropriate primary attractive colors. Such systems are complex in that they require the superimposition of images on three separate exposures, either in three successive cycles, or on a photoreceptor of sufficient circumference or length to accomodate three successive images prior to transfer. Also it is known to use in such systems a series of three separate in-register photoreceptor drums each contributing one image to the final transfer sheet, however, such a system is costly, and can result in images of poor resolution in view of the complexity of the system and the necessity for having three separate photoreceptor drums. In the simpler functional color imaging systems generally only two colors need to be reproduced, although more than two colors can be produced if desired. In one such system, to which the present invention relates there is produced two color functional color documents wherein for example black may be used to represent the main text, and red or blue those selected portions of the text, figures and the like, which portions are to be directed to the users special attention by means of highlight color. In such systems accordingly, there can be produced images in two colors, such as red and black, by desirably employing only one imaging operation. In many instances full color copying is not desired since for example the documents being copied, such as accounting documents and other business documents contain colors of black and red only, in addition to a white background. The photoreceptor device of the present invention can be utilized to produce clored image copies of such documents. Illustrative examples of other documents that may be subjected to the highlight color process of the present invention include technical journals such as Scientific American, a large portion of whose pages are printed in black and highlight color; engineering drawings, letters, reports, and a variety of other documents created by color ink, crayon, signature impression stamp, typewriter ribbon and the like.

There is described in U.S. Pat. No. 4,188,213, issued on Feb. 12, 1980, a method for producing color copies involving a number of complex steps including for example the recording of successive single color electrostatic latent images on an image bearing member, followed by developing each successive color electrostatic latent image with particles containing a predetermined dominant colorant therein corresponding to each recorded single color electrostatic latent image, transferring layers of the developed particles to a sheet of support material, and regulating electrically the transfer step in order that successive thiner layers of particles are transferred from the image bearing member to the sheet of support material. It is disclosed in this patent that development in one embodiment involves the deposition of particles containing a dominant cyan colorant with a minor magenta colorant impurity, on an electrostatic latent image formed from a red filtered image, depositing particles containing a dominant magenta colorant with a minor yellow impurity on the electrostatic latent image formed from a green filtered light image, and depositing particles containing a dominant yellow colorant on the electrostatic latent image formed from a blue filtered light image. Each successive layer of toner particles which are transferred to a sheet of support material, contains a color, corresponding in color, to the color of impurity contained in the previously transferred layer of toner particles. Thus, successive layers of toner particles are transferred in superimposed registration with one another, with each successive transferred layer of toner particles correcting for the impurities contained in the colorant of the previously transferred layer of toner particles, thus producing a combination of toner particles substantially approximating the desired color.

U.S. Pat. No. 4,189,224 solves some of the problems of the process of the '213 patent in that the method described therein requires only a single exposure to derive a two color image, therefore registration and multiple cycling steps are eliminated. More specifically, there is described in U.S. Pat. No. 4,189,224 a two color electrostatic copying apparatus which can be operable for one color positive or negative copying. In accordance with the teachings of this patent, a photoconductive material containing a conductive substrate, an inner photoconductive layer sensitive to visible light, and an outer photoconductive layer insensitive to red light, is subjected to an electrostatic charge, which charge is applied to the outer layer, while at the same time irradiating the device with light so as to render one of the layers conductive. Subsequently, an electrostatic charge of opposite polarity is applied to the outer layer of the photoresponsive member, this step being accomplished in the dark. A light image of an original document is then projected onto the outer layer of the photoresponsive device, wherein white areas of the image cause photoconduction of both layers and red areas thereof, causing photoconduction of only the inner layer, accordingly, as a result, white areas of the material have zero surface potential, while red and black areas have non-zero surface potentials of opposite polarities. The images can then be developed by employing for example red and black toner particles of opposite charge. Thus, for example, red particles which are charged positively will be caused to adhere to negatively charged image areas contained in the photoresponsive device, while black toner particles which are charged negatively will adhere to the black image areas which are charged positively. While the photoresponsive device described in this patent has its advantages, there continues to be a need for photoresponsive devices, particularly improved layered devices which would be useful in a highlight color imaging system, and have advantages in terms of cost, flexibility, choice of spectral response, configuration, versatility, and the like. Further there continues to be a need for layered organic photoresponsive devices possessing the capability of discriminating between two preselected separate input color regions, that is, for example, black and red print regions, versus white background, which devices may be employed to convert black and/or color image input into potential patterns. The patterns can then be developed by a number of known means including the method as described in U.S. Pat. No. 4,078,929, the disclosure of which is totally incorporated herein by reference.

Also, U.S. Pat. No. 4,078,929 discloses a single step electrostatographic copying process in which two different potential levels on a photoresponsive device may be developed in immediate sequence subsequent to a single exposure, by means of two differentially colored xerographic toners. The two potential levels may be of the same polarity or preferably of opposite polarities. In one embodiment of the invention disclosed in the '929 patent, positively charged toner particles of a first color and negatively charged toner particles of a second color are about evenly concentrated in the relatively negative and relatively positive areas of the imaging surface, thus allowing the positively charged toner particles to be attracted to the imaging surface which contains a negative charge pattern, while the negatively charged toner particles of a second color are attracted to the imaging surface which contains a positive charge pattern.

SUMMARY OF THE INVENTION

It is a feature of the present invention to provide an improved electrophotographic imaging device, and a method of color imaging utilizing such device, which overcomes many of the above-noted disadvantages.

A further feature of the present invention is the provision of an improved photoreceptor device for single cycle two color xerographic processes, such as the process disclosed in U.S. Pat. No. 4,078,929, the subject matter of which is totally incorporated herein by reference.

Yet a further feature of the present invention is the provision of an improved photoresponsive device, which device allows red intelligence on the original document to be distinguished from non-red intelligence on a relatively light colored background.

An additional feature of the present invention is the provision of an improved photoresponsive device containing a base electrode material which enables reliable dark induction charging by insuring the dark injection of holes (positive charge carriers) from the electrode into other layers of the device.

A further feature of the present invention is the provision of a five layered photoresponsive device which is useful in producing images in a two color system, for example black and red, black and green, or black and blue, all on a white background.

These and other features of the present invention are accomplished by providing an improved layered photoresponsive device which is comprised in the order stated of (1) a supporting substrate, (2) a layer of hole injecting material capable of injecting holes into a layer on its surface, (3) a dielectric hole transport layer, capable of actively transporting injected positive charges, (4) a red sensitive charge carrier photogenerating layer, sensitive to long wavelengths and (5) a layer which is sensitive only to relatively short wavelengths and is transparent to relatively long wavelengths as described hereinafter. In one important embodiment of the present invention, the supporting substrate can be electrically conductive or non-conductive, the hole injecting layer comprises a combination of an organic adhesive resin having dispersed therein carbon black particles, the hole transport layer is comprised of a combination of a highly insulating organic resin having dissolved therein small molecules of an electrically active material, the photogenerating layer is comprised of red sensitive materials such as a dispersion of a metal free phthalocyanine, or vanadyl phthalocyanine and the like; and the top overcoating layer is comprised of a photoconductive material with spectral sensitivity extending through the visible range up to about 620 millimicrons, these materials including pyrylium salts, and the like.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
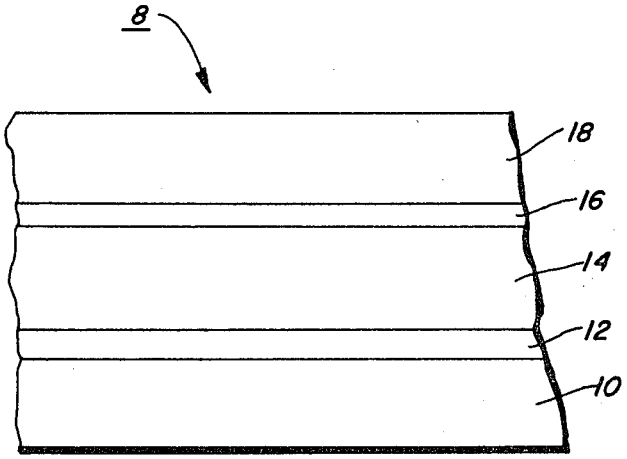
FIG. 1 is a partially schematic cross-sectional view of the improved photoresponsive device of the present invention.
Figure 2:
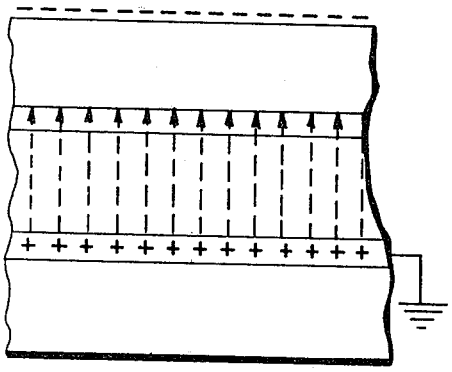
FIGS. 2–5 illustrates the various method steps utilized in producing a color image employing the improved photoresponsive device of the present invention.
Figure 3:
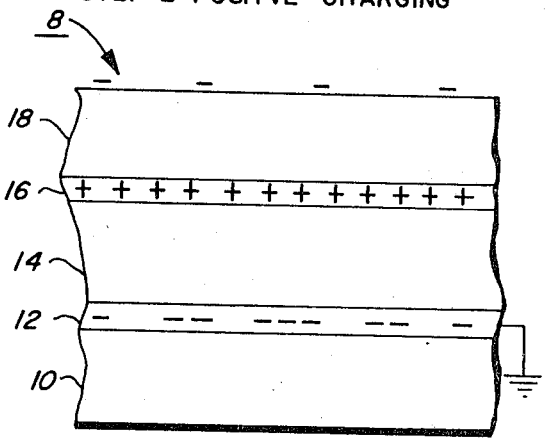
Figure 4:
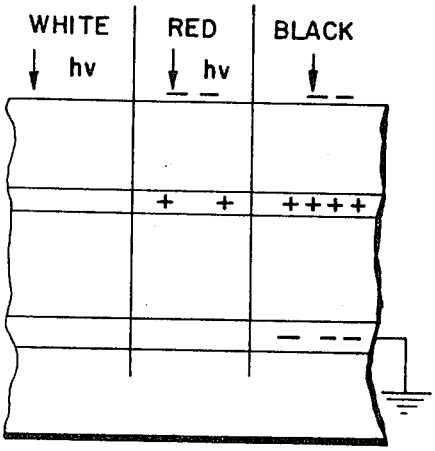
Figure 5:
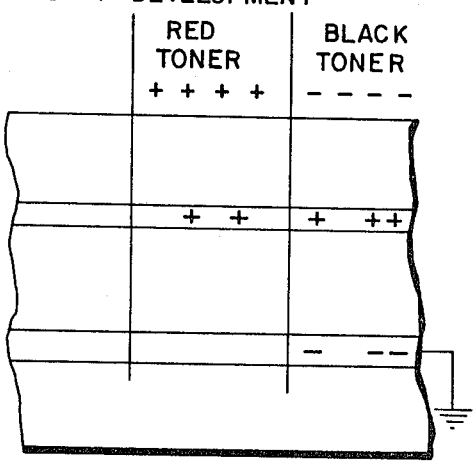

Illustrated in FIG. 1 is the improved photoreceptor device of the present invention generally designated 8 comprising a substrate 10, a hole injecting layer 12, a hole transport dielectric layer 14, capable of actively transporting the injected positive holes from the hole injecting layer, a charge carrier red sensitive photogenerating layer 16, and a photosensitive photoconductive dielectric overcoating layer 18 sensitive to relatively short wavelengths.

Substrate 10 may be opaque or substantially transparent and may comprise various suitable materials having the requisite mechanical properties. Thus, the substrate may be comprised of a layer of non-conducting material such as an inorganic or organic polymeric material, like Mylar; a layer of an organic or inorganic material having a conductive surface layer arranged thereon or a conductive material such as, for example aluminum, brass and the like. Preferably, the substrate is comprised of an aluminized polyethylene terephthalate material. The substrate may be flexible or rigid and may have any of many different configurations such as, for example, a plate, a cylindrical drum, a scroll, an endless flexible belt, and the like. Preferably, the substrate is in the form of an endless flexible belt.

The thickness of the substrate layer depends on many factors, including economical considerations, thus this layer may be of substantial thickness, for example, over 100 mils, or minimum thickness, providing there are not adverse effects on the system. In one preferred embodiment the thickness of this layer ranges from about 3 mils to about 10 mils, or from about 75 microns to about 250 microns.

The hole injecting layer 12 must be capable of injecting charge carriers or holes into the charge carrier transport layer 14 under the influence of an electrical field, wherein the injected charge carriers are of the same polarity as the mobile carriers preferentially transported by layer 14. In one embodiment, the charge carrier injecting layer may be sufficiently laterally conductive, enabling it to also serve as the ground electrode for the photoreceptor, in which case a separate additional substrate layer is not required.

Illustrative examples of materials which are capable of injecting charge carriers under the influence of an electrical field and therefore are suitable for use in layer 12 include carbon black or graphite dispersed in various polymer resins, this layer being prepared by solution casting of a mixture of carbon black or graphite dispersed in an adhesive polymer solution on to a support substrate such as Mylar, or aluminized Mylar. Other well known film forming techniques can be used for preparing this layer such as spraying or thermal film extrusion. The dispersed carbon black or graphite functions as a hole injecting electrode as well as a conductive medium, and the polymer acts as a substantially permanent adhesive. One very important advantage associated with the use of a carbon black or graphite dispersion is that it adheres substantially permanently to the support substrate, as well as to the transport layer, which is not the situation when using materials, for example, such as gold and aluminum. Therefore, the injecting layer does not have a tendency to peel off, that is, to be separated from the transport, and the support layer, thus the quality of images produced is not adversely affected after repetitive usage. Additionally, although it is possible to redeposit the gold and aluminum and prepare a further photoreceptor after sufficient peeling has been noticed, this is not only time consuming but is very uneconomical. In any event, carbon black and graphite are rather inexpensive materials when compared to gold and aluminum, are more readily available, and function more effectively than gold or aluminum.

Illustrative examples of polymers that can be used as the material within which the carbon black or graphite is dispersed include, for example, polyesters such as PE-100, commercially available from Goodyear Chemical Company. Other polyester materials that are useful include those materials classified as polymeric esterification products of a dicarboxylic acid and a diol comprising a diphenol. Typical diphenols include 2,2-bis(4-beta hydroxy ethoxy phenyl)-propane, 2,2-bis(4-hydroxy isopropoxy phenyl)propane, 2,2-bis(4-beta hydroxy ethoxy phenyl)pentane, 2,2-bis(4-beta hydroxy ethoxy phenyl)butane and the like, while typical dicarboxylic acids include oxalic acid, malonic acid, succinic acid, adipic acid, phthalic acid, terephthalic acid, maleic acid, fumaric acid and the like. Any polyester of other polymeric materials may be used providing they do not adversely affect the system, and allow a uniform dispersion of the carbon black or graphite therein.

Numerous forms of carbon black and graphite are useful including furnace carbon blacks and channel carbon blacks commercially available from many sources, such as Cabot Corporation. Illustrative examples of these materials include carbon blacks, such as Vulcan XC-72R, Vulcan 6, Black Pearls L, and Monarch 1300, all commercially available from Cabot Corporation; and graphite commercially available from Superior Graphite Co. Other carbon blacks are useful providing they do not substantially adversely affect the imaging method; however, such materials should have sufficient conductivity, be capable of injecting holes which is most important, and be capable of being uniformly dispersed in a polymer material.

The ratio of polymer to carbon black or graphite ranges from about 0.5 to 1 to 2 to 1, with a preferred ratio of about 6 parts of polymer for every 5 parts of carbon black or grahite. Other ratios are suitable providing a uniform dispersion of carbon black or graphite results.

The hole injecting layer has a thickness in the range of from about 1 to about 20 microns or more, with the preferred range being from about 4 microns to about 10 microns. The maximum thickness is generally determined by the mechanical properties desired. The charge carrier injecting materials and charge carrier transport materials require a particular work function relationship in order that the holes to be injected from the former into the latter can be effectively acomplished. Normally the hole injecting materials have a relatively high work function whereas electron injecting materials have a relatively low work function.

The charge carrier transport layer 14 can be any number of numerous suitable materials which are capable of transporting holes, this layer generally have a thickness in the range of from about 5 to about 50 microns, and preferably from about 20 to about 40 microns. In a preferred embodiment this transport layer comprises molecules of the formula:

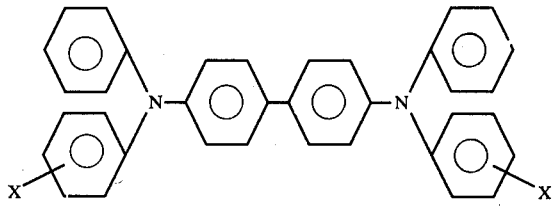

dispersed in a highly insulating and transparent organic resinous material wherein X is selected from the group consisting of (ortho) $CH_3$, (meta) $CH_3$, (para) $CH_3$, (ortho) Cl, (meta) Cl, (para) Cl. This charge transport layer, which is described in detail in U.S. Pat. No. 4,265,990, is substantially non-absorbing in the spectral region of intended use, i.e., visible light, but is "active" in that it allows injection of photogenerated holes from the charge carrier generator layer and electrically induced holes from the injecting interface. The highly insulating resin, which has a resistivity of at least $10^{12}$ ohm-cm to prevent undue dark decay, is a material which is not necessarily capable of supporting the injection of holes from the injecting or generator layer and is not capable of allowing the transport of these holes through the material. However, the resin becomes electrically active when it contains from about 10 to 75 weight percent of the substituted N,N,N',N'-tetraphenyl[1,1'-biphenyl]4,4'-diamines corresponding to the foregoing formula. Compounds corresponding to this formula include, for example, N,N'-diphenyl-N,N'-bis-(alkylphenyl)-[1,1-bi-phenyl]-4,4'-diamine wherein alkyl is selected from the group consisting of methyl such as 2-methyl, 3-methyl and 4-methyl, ethyl, propyl, butyl, hexyl, and the like, N,N'-diphenyl-N,N'-bis(halo phenyl)-[1,1'-biphenyl]-4,4'-diamine wherein halo is 2-chloro, 3-chloro or 4-chloro.

Other electrically active small molecules which can be dispersed in the electrically inactive resin to form a layer which will transport holes include triphenylmethane, bis(4-diethylamino-2-methylphenyl) phenylmethane; 4,4'-bis(diethylamino)-2',2''-dimethyltriphenyl methane; bis(4-diethylamino phenyl) phenylmethane; 4,4'-bis(diethylamino)-2,2'-dimethyltriphenylmethane, and certain oxadiazoles.

Transport layer 14 may comprise various suitable transparent electrically inactive binder resinous material such as those described by Middleton, et al, U.S. Pat. No. 3,121,006, the disclosure in its entirety being incorporated herein by reference. As indicated herein, the resinous binder contains from 10 to 75 weight percent of the active material corresponding to the foregoing formula, and preferably from about 40 to about 50 weight percent of this material. Typical organic resinous materials useful as the binder include polycarbonates, acrylate polymers, vinyl polymers, polystyrene polymers, cellulose polymers, polyesters, polysiloxanes, polyamides, polyurethanes and epoxies, as well as block, random or alternating copolymers thereof. Preferred electrically inactive binder materials are polycarbonate resins having a molecular weight ($M_w$) of from about 20,000 to about 100,000 with a molecular weight in the range of from about 50,000 to about 100,000 being particularly preferred.

The red sensitive charge carrier photogenerating layer 16 which is sensitive to wavelengths ranging from about 610 millimicrons to 680 millimicrons, and preferably from about 620 millimicrons to about 660 millimicrons, may comprise photoconductive charge carrier generating materials known for use in electrophotography provided they are (1) electronically compatible with charge carrier transport layer 14, (2) can inject photoexcited charge carriers into the transport layer, and (3) charge carriers can travel in both directions across the interface between the two layers. Particularly preferred red sensitive charge carrier photogenerating materials include trigonal selenium, selenium-arsenic alloys, such as arsenic triselenide, and selenium-tellurium alloys, complexes of polyvinyl carbazole with trinitro-fluorene, metal-free phthalocyanines, such as the X-form of phthalocyanine, metal phthalocyanines, vanadyl phthalocyanine, and squarylium dyes, such as bis-dialkylaminophenyl cyclic dioxide compounds, including 1,3-bis(4-dimethylamino-2-phenyl) cyclobutene diylium dioxide dispersed in a polyester polymer. These materials can be used alone or as a dispersion in a polymeric binder. Layer 16 is typically from about 0.5 to about 10 microns or more in thickness. Generally, it is desired to provide this layer in a thickness which is sufficient to absorb at least 90 percent (or more) of the incident radiation which is directed upon it in the imagewise exposure step. The maximum thickness is dependent primarily on factors such as mechanical considerations, e.g., whether a flexible photoreceptor is desired.

Illustrative examples of materials useful for the top layer 18 which is sensitive only to relatively short wavelengths and is transparent to relatively long wavelengths includes photoconductive materials with spectral sensitivity extending through the visible range to about 620 millimicrons and preferably up to about 605 millimicrons, such materials including amorphous selenium, dispersions of pyrylium salts, thiapyrylium salts, fluorol dyes, dye sensitized polyvinylcarbazole and the like. This layer ranges in thickness of from about 5 to about 25 microns.

The operation of the photoresponsive device of the present invention is illustrated in FIGS. 2–5. Initially, in step 1, the photoreceptor device of the present invention as illustrated in FIG. 1 is charged negatively in the dark utilizing a DC corotron, and the induced positive charges or holes are injected in the dark from the interface of the hole transport layer 14, and the hole injecting layer 12, into the hole transport layer, which charges accumulate at the interface of the top layer 18 and the charge carrier generating layer 16. As shown, the surface potential of the photoresponsive device, subsequent to the completion of step 1 is negative. Subsequently, the photoresponsive device is subjected to positive charging in the dark, reference step 2, for the purpose of reversing the net surface potential from a negative polarity to a positive polarity, however, some negative charges remain on the top surface of layer 18. Upon completion of this step, the net surface potential of the photoresponsive device is positive. Thereafter, the device is subjected to an imagewise exposure, reference step 3, wherein the black image areas (no exposure) remains as a positive surface potential area. In the non-image area, (white light exposure) both layers 16 and 18 absorb light and become conductive, thus causing all the charges to be neutralized, and the surface potential of the device to be reduced to near zero. In the red image area, (red light exposure) layer 16, and not the other layers, absorbs red light, and photogenerates charge carriers. Photogenerated electrons neutralize some of the trapped holes at the interface of layers 16 and 18, and photogenerated holes migrate through the hole transport layer 14, and neutralize the negative charges trapped at the interface of the hole transport layer 14, and the hole injecting layer 12. A net negative surface potential is therefore produced in the red image area subsequent to completion of step 3. Thereafter, development can be accomplished as described in U.S. Pat. No. 4,079,928, reference FIG. 5, wherein an appropriate developer composition, containing positively charged red toner particles adhere to the red image area, (negative surface potential) and negatively charged black toner particles adhere to the black image areas, (net positive surface potential). The developed image can then be transferred to a suitable substrate, and permanently fixed thereon. Accordingly, in one aspect, the present invention is directed to certain layered organic photoresponsive devices capable of generating a bipolar charge pattern, containing image configurations of positive and negative charges, which respectively represent black and red colored areas of intelligence projected from an original document to be reproduced. Although preferred, it is not essential that black be reproduced as black, or that red be reproduced as red.

With further reference to the device of the present invention, as indicated herein, it is comprised of two layers of photosensitive material, color filter, top layer 18 which is sensitive only to relatively short wavelengths, and is transparent to relatively long wavelengths, and layer 16 which responds to long wavelengths, and is shielded against radiation of shorter wavelengths by the top layer.

Red, and non-red image patterns are distinguished primarily since layer 16, of the photoresponsive device of the present invention is photoresponsive to the red radiation, that is, a radiation ranging in wavelength of from about 610 to about 680 millimicrons, and peaking from about 620 to about 660 millimicrons.

Illustrative examples of toner particles that may be utilized in the present invention include toner resins containing therein a suitable colorant or pigment such as carbon black, magenta, cyan, and yellow pigments, such resins being for example polyamides, epoxies, polyurethanes, vinyl esters, and polyesters especially those prepared from dicarboxylic acids and diols comprising diphenol. Various suitable vinyl resins may be employed including homopolyers or copolymers of two or more vinyl monomers, examples of such vinyl monomers including styrene, vinyl naphthalene, ethylene, propylene, butylene, and the like, vinyl halide such as vinyl chloride, vinyl bromide, vinyl esters such as vinyl acetate, esters of alpha methylene aliphatic mono carboxylic acids such as methylacrylate, ethylacrylate, and butylacrylate, methylmethacrylate, ethylmethacrylate, butylmethacrylate, and the like. Generally preferred are resins containing a relatively high percentage of styrene. Further, esterification products of a dicarboxylic acid and a diol comprising a diphenol may be used as the resin material for the toner composition of the present invention, these materials being illustrated in U.S. Pat. No. 3,655,374, the disclosure of which is totally incorporated herein by reference.

Illustrative examples of carrier materials that are employed in the developer composition, include those carrier particles that are capable of imparting a negative triboelectric charge, and a positive triboelectric charge to the respective toner compositions being employed, the core of such carrier particles including steel, nickel, iron ferrites, silicon dioxide, polymeric materials such as methylmethacrylate, and the like. To obtain positively charged carrier particles, the carrier core is coated with various polymeric materials, such as styrene, methyl methacrylates, and the like, while to obtain negatively charged carrier particles, the carrier core is coated with halogen containing fluoropolymers, including tetrafluoroethylenes, vinylidene fluorides, and the like. Illustrative examples of typical carrier materials that can be employed are described for example in U.S. Pat. Nos. 3,353,835, 3,591,503, 3,618,522, and 3,526,553.

The invention will now be described in detail with respect to specific preferred embodiments, it being noted that such embodiments are intended to be illustrative only, and the invention is not intended to be limited to the conditions specified in the examples. All parts and percentages are by weight unless otherwise indicated.

EXAMPLE I

A photoresponsive device is fabricated by coating a hole injecting layer, containing a mixture of 6 percent of a polyester resin, commercially available from Goodyear Chemical Company as PE-100, and 5 percent Monarch 1300 carbon black, commercially available from Cabot Corporation (in chloroform and ball milled for 17 hours) onto the conductive side of an aluminized polyethylene terephthalate film substrate (Mylar), having a thickness of about 125 microns. The coating is applied using a film coating apparatus equipped with a 1.5 mil wet film gap applicator. The uniformly coated film is dried in a vacuum oven at about 60° C. for 3 hours, to yield a dry film having a thickness of about 5 microns. The dried film is then overcoated with a hole transport layer comprised of a 1:1 weight ratio of N,N-diphenyl-N,N'-bis(3-methylphenyl)[1,1-biphenyl]-4,4' diamine, and a Makrolon polycarbonate polymer commercially available from Mobay Chemical Corporation, using the above coating apparatus equipped with a 3 mil wet film applicator bar. The coating is dried in a vacuum oven at a temperature of about 70° C. for about 24 hours. The dried hole transport layer is about 18 microns thick. About 30 weight percent of a vanadyl phthalocyanine pigment is dispersed in a methylene chloride solution of a polyester resin, commercially available as PE-100 prepared by milling the mixture with ⅛" steel shot for 90 minutes, on a Red Devil Paint conditioner available from Gardner Laboratories, Bethesda Maryland. The coating is applied with a 0.5 mil wet film gap applicator, to yield after vacuum drying at 55° C. for 17 hours, a 0.5 micron thick red light sensitive photoconductive coating. The photoresponsive device is completed by vacuum evaporating a coating of amorphous selenium on top of the vanadyl pathalocyanine, PE-100 layer, to a thickness of about 15 microns.

The completed photoresponsive device is utilized for two color imaging by negatively charging the device in the dark to a potential of −750 volts with a corotron. As a result of this charging, holes are injected from the hole injecting layer into the hole transporting layer, which holes are transported and trapped at the interface of the vanadyl phthalocyanine layer, and the selenim layer. Subsequently, there is applied to the selenium top coating a potential of +750 volts, which charging essentially neutralizes the previous charge, however, some negative charges remain because of the positive charges trapped at interface of the vanadyl phthalocyanine-selenium layers. The net electrostatic potential on the surface of the device is now positive. Thereafter, the device is exposed to a two color red and black original text image, by a first exposure of the image through a red filter. In the exposed areas of the device, the positive charges trapped at the vanadyl phthalocyanine layer dissipate, leaving only positive charge equal to the negative charge on the selenium surface. The discharged areas correspond to white background, and the red image areas of the original. The non-exposed areas, retain a positive charge and are subsequently developed as the black image. The device is then exposed to the image through a cyan filter which effectively dissipates charge in the white background areas, and the non-exposed areas correspond to black and red text information, which remains charged. The charge polarity is negative, and is developed as the red image.

The image is developed by sequentially passing the photoreceptor device through colored magnetic brush developers contained in separate developer supply stations. The negatively charged black developer present in one station contained 10 percent of carbon black pigment dispersed in 90 percent of a styrene n-butylmethacrylate copolymer, 65 percent styrene, 35 percent n-butyl methacrylate, and steel carrier beads, 100 microns in diameter, coated with 0.4 weight percent of methylmethacrylate styrene copolymer, 85 percent methacrylate, 15 percent styrene. The toner, which is negatively charged is contained on the carrier in a concentration of 1.5 weight percent. The positive charged red developer is produced by melt mixing 2 weight percent of CI Solvent Red 24 dye in a styrene n-butylmethacrylate resin, (65/35) together with 1 weight percent of dimethyl distearyl ammonium chloride as a psitive toner charge control additive resulting in toner particles of 12 microns in diameter. The carrier is produced by coating a steel bead, 100 microns in diameter with 2 weight percent of polyvinylidene fluoride resin, by dry blending of the steel carrier beads, and polymer powder, followed by melt fusion of the resin to the carrier surface. The toner concentration of the developer is about 2.5 weight percent.

There is produced two colored black and red images of high resolution, and excellent image quality. The device is then cleaned of residual toner particles, and can be reused to produce additional color images.

EXAMPLE II

A photoresponsive device is prepared in accordance with Example 1, with the exception that there is used a hole injection layer containing a 12 percent solution of the polyester resin containing about 10 weight percent of Black Pearls L carbon black commercially availble from Cabot Corporation; a hole transport layer containing about 40 weight percent of N,N'-diphenyl-N,N'bis(3-methylphenyl)[1-1-biphenyl]4,4' diamine in a polystyrene polymer, 1:1 ratio; the red sensitive layer consists of a selenium tellurium alloy, 75 percent selenium, 25 percent tellurium, 2 microns in thickness, and the top layer is amorphous selenium, 20 microns in thickness.

Imaging and development is accomplished in accordance with Example I, with substantially similar results.

EXAMPLE III

A photoresponsive device is prepared in accordance with Example I, with the exception that there is used a hole injecting layer containing 5 percent graphite, commercially available from Superior Graphite Company, dispersed in 6 percent of the polyester resin; a hole transport, 15 microns in thickness, layer contains in a 1:1 ratio 2.5-bis(4'-dimethyl aminophenyl)-1,3,4-oxadiazole dissolved in VYNS, a vinylchloride vinylacetate copolymer commercially available from Union Carbide Corporation, the red sensitive layer consists of a 1 micron coating of 36 weight percent of 1,3-bis(4-dimethylamino-2-phenyl) cyclobutenediylium dioxide, dispersed in PE-200, a polymer commercially available from Goodyear Chemical Company using a 1:1 solvent ratio mixture of methylethyl ketone and toluene; and a top coating of amorphous selenium, 10 microns in thickness.

Imaging and development is accomplished in accordance with Example I, with substantially similar results.

EXAMPLE IV

A photoreceptor device is fabricated in accordance with Example III, with the exception that 1,3-bis(4'-dimethylamino-2-hydroxyphenyl) cyclobutenediylium dioxide is used to form the red sensitive layer.

Imaging and development is accomplished in accordance with Example I, with substantially similar results.

EXAMPLE V

A photoreceptor device is fabricated in accordance with Example III with the exception that 1,3-bis(4'-dimethylamino-2-methylphenyl) cyclobutenediylium dioxide is used to form the red sensitive layer.

Imaging and development is accomplished in accordance with Example I, with substantially similar results.

EXAMPLE VI

A photoreceptor device is fabrciated in accordance with Example III with the exception that a 1:1 molar complex of polyvinyl carbazole and 2,4,7-trinitro-9-fluorene is used as the red sensitive coating, which is deposited from a 3:1 by volume blend of tetrahydrofurane and toluene, to yield a dry film thickness of about 2 microns.

Imaging and development is accomplished in accordance with Example I, with substantially similar results.

EXAMPLE VII

A photoresponsive device is fabricated in accordance with Example I, with the exception that the red sensitive layer is a pigment dispersion of X-form metal-free phthalocyanine.

Imaging and development is accomplished in accordance with Example I, with substantially similar results.

EXAMPLE VIII

A photoreceptor device similar to that of Example II is prepared, with the exception that the red sensitive layer consists of about 1 micron of an arsenic triselenide coating. This device is additionally coated with a hole trapping layer situated between the arsenic triselenide coating and the short wave sensitive amorphous selenium layer; the trapping layer containing a 0.25 micron thickness of the polyester polymer, PE-100, deposited from methylene chloride solvent using a 0.5 mil wet film gap applicator.

Imaging and development is accomplished in accordance with Example I, with substantially similar results.

Other modifications of the present invention will occur to those skilled in the art based upon a reading of the present disclosure, and these modifications are intended to be included within the scope of this invention.

What is claimed is:

1. An improved layered organic photoresponsive device, useful in highlight color imaging processes, which device is comprised in the order stated of (1) a supporting substrate, (2) a layer of material capable of injecting holes into a layer on its surface, this layer being comprised of a material selected from the group consisting of carbon dispersed in a polymer, and graphite dispersed in a polymer, (3) a hole transport layer in operative contact with the layer of hole injecting material, which transport layer comprises a combination of a highly insulating organic resin having dispersed therein small molecules of an electrically active material, the combination of which is substantially non-absorbing to visible light but allows injection of photogenerated holes from a photogenerating layer in contact with the hole transport layer, and electrically induced holes from the layer of injecting material, (4) a red sensitive charge carrier photogenerating layer sensitive to wavelengths ranging from about 610 millimicrons to about 680 millimicrons, and (5) a top layer of a photoconductive material sensitive only to relatively short wavelengths ranging from about the visible range to about 620 millimicrons, said layer being transparent to light of wavelengths of greater than 620 millimicrons.

2. An improved layered organic photoresponsive device in accordance with claim 1 wherein the supporting substrate is electrically conductive, the red sensitive layer is comprised of vanadyl phthalocyanine, or x-metal free phthalocyanine and the top layer is comprised of amorphous selenium.

3. An improved layered photoresponsive device in accordance with claim 1 wherein the red sensitive layer is a selenium tellurium alloy.

4. An improved layered photoresponsive device in accordance with claim 1 wherein the red sensitive layer is 1,3 bis(4-dimethyl amino-2-phenyl) cyclobutenediylium dioxide.

5. An improved layered photoresponsive device in accordance with claim 1 wherein the red sensitive layer is 1,3-bis(4'-dimethylamino-2-hydroxy phenyl) cyclobutenediylium dioxide.

6. An improved layered photoresponsive device in accordance with claim 1 wherein the red sensitive layer is 1,3-bis(4'-dimethylamino-2-methyl phenyl) cyclobutenediylium oxide.

7. An improved layered photoresponsive device in accordance with claim 1 wherein the red sensitive layer is a complex of polyvinyl carbazole and trinitrofluorene.

8. An improved layered organic photoresponsive device in accordance with claim 1 wherein the thickness of the substrate ranges from about 3 mils to about 100 mils, the thickness of the hole injecting layer ranges from about 1 micron to about 20 microns, the thickness of the charge transport layer ranges from about 5 microns to about 50 microns, the thickness of the red sensitive layer ranges from about 0.5 microns to about 10 microns, and the thickness of the top layer ranges from about 5 microns to about 40 microns.

9. An improved layered organic photoresponsive device in accordance with claim 1, wherein the electrically active material dispersed in an insulating organic resin is a nitrogen containing compound of the formula:

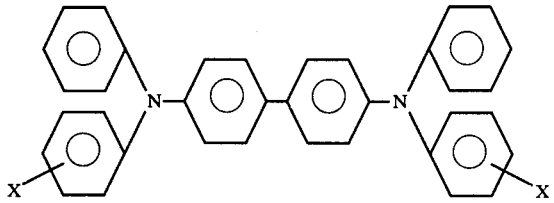

wherein X is selected from the group consisting of (ortho) $CH_3$, (meta) $CH_3$, (para) $CH_3$, (chloro) Cl, (meta) Cl and (para) Cl.

10. An improved layered organic photoresponsive device in accordance with claim 9 wherein the hole transport layer contains from about 10 to about 75 percent of a nitrogen containing composition.

11. An improved layered organic photoresponsive device in accordance with claim 9 wherein the transport layer is N,N'-diphenyl-N,N'-bis(3-methylphenyl)-[1,1'-biphenyl]-4,4'-diamine.

12. An improved process of color imaging which comprises subjecting an organic layered photoresponsive device comprised in the order stated of (1) a supporting substrate, (2) a layer of material capable of injecting holes into a layer on its surface, this layer being comprised of material selected from the group consisting of carbon dispersed in a polymer, and graphite dispersed in a polymer, (3) a hole transport layer in operative contact with the layer of hole injecting material, which transport layer comprises a combination of a highly insulating organic resin having dispersed therein small molecules of an electrically active material, the combination of which is substantially non-absorbing to visible light but allows injection of photogenerated holes from a photogenerating layer in contact with the hole transport layer, and electrically induced holes from the layer of injecting material, (4) a red sensitive charge carrier photogenerating layer sensitive to wavelengths ranging from about 610 millimicrons to about 680 millimicrons, and (5) a top layer of a photoconductive material sensitive only to relatively short wavelengths ranging from about the visible range to about 620 millimicrons, said layer being transparent to light of wavelengths of greater than 620 millimicrons, subjecting the device to negative charges, followed by subjecting the device to positive charges, imagewise exposing the member, and developing the resulting surface potential with a colored developer composition comprised of positively charged toner components and negatively charged toner components, and carrier particles.

13. An improved imaging process in accordance with claim 12 wherein the positively charged components of the toner composition contain red toner particles, and the negatively charged components of the toner composition is comprised of black toner particles, wherein the red toner particles adhere to the red image area, or negative surface potential of the photoresponsive device, and the black toner particles adhere to the black image area or the area of the photoresponsive device containing a net positive surface potential.

14. An improved imaging process in accordance with claim 12 wherein the resulting image is transferred to a suitable substrate and permanently affixed thereto.

15. An improved imaging process in accordance with claim 12 wherein the supporting substrate is electrically conductive, the red sensitive layer is comprised of vanadyl phthalocyanine, or x-metal free phthalocyanine and the top layer is comprised of amorphous selenium.

16. An improved imaging process in accordance with claim 12 wherein the red sensitive layer is a selenium tellurium alloy.

17. An improved imaging process in accordance with claim 1 wherein the red sensitive layer is 1,3-bis(4-dimethyl amino-2-phenyl) cyclobutenediylium dioxide.

18. An improved imaging process in accordance with claim 12 wherein the red sensitive layer is 1,3-bis(4'-dimethylamino-2-hydroxy phenyl) cyclobutenediylium dioxide.

19. An improved imaging process in accordance with claim 12 wherein the red sensitive layer is 1,3-bis(4'-dimethylamino-2-methyl phenyl) cyclobutenediylium dioxide.

20. An improved imaging process in accordance with claim 12 wherein the red sensitive layer is a complex of polyvinyl carbazole and trinitrofluorene.

21. An improved imaging process in accordance with claim 12 wherein the thickness of the substrate ranges from about 3 mils to about 100 mils, the thickness of the hole injecting layer ranges from about 1 micron to about 20 microns, the thickness of the charge transport layer ranges from about 5 microns to about 50 microns, the thickness of the red sensitive layer ranges from about 0.5 microns to about 10 microns, and the thickness of the top layer ranges from about 5 microns to about 40 microns.

* * * * *